United States Patent [19]

Rabbitts

[11] 4,101,172

[45] Jul. 18, 1978

[54] IN-SITU METHODS OF EXTRACTING BITUMEN VALUES FROM OIL-SAND DEPOSITS

[76] Inventor: Leonard C. Rabbitts, Big Chief Rd. R.R. #3, Orillia, Ontario, Canada

[21] Appl. No.: 748,822

[22] Filed: Dec. 9, 1976

[30] Foreign Application Priority Data

Dec. 22, 1975 [CA] Canada ..... 242305

[51] Int. Cl.[2] ..... E21B 43/25; E21C 41/10

[52] U.S. Cl. ..... 299/2; 166/271; 166/272

[58] Field of Search ..... 299/2

[56] References Cited

U.S. PATENT DOCUMENTS

| | | | |
|---|---|---|---|
| 1,735,481 | 11/1929 | Uren | 299/2 |
| 1,804,692 | 5/1931 | Jackson | 299/2 |
| 1,811,560 | 6/1931 | Ranney | 299/2 |
| 1,851,446 | 3/1932 | Ranney | 299/2 |
| 1,870,869 | 8/1932 | Ranney et al. | 299/2 |
| 1,884,858 | 10/1932 | Ranney | 299/2 X |
| 1,935,643 | 11/1933 | Laughlin | 299/2 |
| 2,481,051 | 9/1949 | Uren | 299/2 |

*Primary Examiner*—Ernest R. Purser
*Attorney, Agent, or Firm*—Murray and Whisenhunt

[57] ABSTRACT

The present invention provides a method of in situ extraction of bitumen from an oil-sands body which method comprises sinking an access shaft through the oil-sands body, driving an access drift in the rock strata underlying the oil-sands body, delineating a rectangular block of oil-sands in said body by drilling and blasting the oil-sands body to provide substantially vertical planes of fractured oil-sands on all four sides of an enclosed mining room capable of retaining liquids and gases under pressure and comprising solid pillar walls, providing generally upwardly extending bores in said block of oil sands from the access drift in the said body, providing perforated pipes in those portions of the bores in said block, the perforations of said pipes being dimensioned to prevent sand particles from said block passing therethrough, increasing the permeability of the block of oil sands within said room by fracturing said block, flooding the mining room with a hot fluid at a temperature and for a residence time sufficient to raise the temperature of the block by an amount to cause the bitumen to become flowable with said fluid and removing the fluid-bitumen mixture so formed from said block, the passage of said fluid through said bed being via said perforated pipes and separating said bitumen from said fluid.

40 Claims, 5 Drawing Figures

IN-SITU METHODS OF EXTRACTING BITUMEN VALUES FROM OIL-SAND DEPOSITS

The present invention relates to the recovery of hydrocarbons from oil-sands. In particular, the present invention relates to a method of in situ recovery of hydrocarbons from oil-sands deposits at any depth of burial without disturbing the overburden and without contamination of surface water. The method of the present invention is particularly suitable for the recovery of bitumen from low grade oil-sands employing a low level of mechanical equipment, having low maintenance and operating costs and utilizing a low level of labour. The method of the present invention takes place underground and thus avoids climatic problems associated with the conventional commercial methods of obtaining hydrocarbons from oil-sands deposits and allows uniform year round operating conditions.

Deposits of bituminous sand are found in various localities throughout the world. The term "bituminous sand" as used herein includes those materials commonly referred to as oil-sand and tar-sand and the like. Large deposits of these bituminous sands are located in Northern Alberta, Canada where the four major deposits cover an area of 19,000 sq. miles and contain about 600 billion barrels of reserves in place. The largest deposit is the Athabasca deposit which contains over two-thirds of all Alberta's bituminous sand reserves.

Several basic extraction methods have been known for years for the separation of bitumen from the sands and are now operated on a commercial scale. They include the so-called "cold water" method and the "hot water" method. Both of these methods involve open pit mining methods utilizing bucket wheel excavators or draglines. The initial step in these processes is the removal of overburden preceded by clearing of the ground surface. The surface of the oil sands mining area is often characterized by swamps and muskeg with poor drainage. Initial removal of tree and plant cover helps the surface to dry naturally. After removal of trees and roots etc. the overburden can be removed using conventional earth moving equipment. The overburden, which is defined as the thickness of the sediment above a desired grade of oil sand will depend upon the cutoff value chosen and will include a varying thickness of poorly saturated silty oil sands commonly found on top of the oil sands formation. In addition to the lower grade oil sands, the overburden may also include marine sandstones and shales plus glacial till, swamps and muskeg or some combination of these groups. Thus the depth of burial from the surface to the top of commercial oil impregnated strata can vary from 0 to 2000 feet. The depth of overburden and grade of oil sands are the principal determining factors which decide the economic feasibility of open pit mining methods. At the present time less than 10% of Alberta's oil sand reserves can be recovered by open pit mining methods due to excessive depth of the overburden.

One problem associated with oil sands open pit mining operations is extreme conditions of weather and climate which in Northern Alberta includes extreme cold in wintertime. Most of the oil sands deposits there are covered with an overburden and when the overburden is removed and the oil sands laid bare and exposed to the cold, frost penetration can be evident down to a depth of 10 feet below the exposed oil sand surfaces. In the summertime, the oil sands may be soft and heavy machinery can sink in to the exposed sand beds. The degree of ground softness however, depends not only on the summer temperatures but also on the bitumen content, the particle size of the sand, the amount of moisture and the gas concentration in the oil sand. Thus, under normal summer conditions, the viscous fluid film between the sand grains binds the mass together like a fine grained asphalt road mix and the oil sand on the mining faces is minable without prior preparation. In the wintertime, a mining face which has not been disturbed is similar to concrete but tougher and will not shatter in the cold. The bitumen matrix between the sand grains is merely more viscous. Under these operating conditions, excavating the face is virtually impossible without first loosening with explosives. Mechanical equipment is subject to violent abuse and maintenance efficiency in subzero weather is very low. Once the frozen surface is penetrated, the sand excavated is about 40° F. In excavating the 40° F material, the water envelope around the sand particles is ruptured. A considerable amount of water vapour is released into the atmosphere and visibility drops. The water tends to freeze and frozen masses of oil sands adhere to the digging equipment, freeze to the conveyors, build up in the transfer points and cause general distress. Occasionally large blocks of frozen sand may peel out along the planes of weakness and endanger the machinery working below. Another problem caused by frozen lumps is the additional damage and wear to mechanical equipment such as excavators, conveyors, chutes, feeders, and conditioning drum baffles as well as the additional steam requirements necessary to heat this frozen material up to the required 170° F range for the hot water processing.

Another problem encountered during winter operation of open pit mining has been the difficulty in breaking down large frozen lumps of oil-sands during the mulling operation in the hot water process. At low temperatures, the oil-sands from the mining area are rock hard. Significant amounts of these sands are not reduced and broken down during the mulling period, but pass through the conditioning drum as oversize which is removed by screening and the losses of these oversize rejections, still containing recoverable bitumen, are significantly higher in the winter months than in the summertime. In large plants, oversize rejections can range from 10,000 to 15,000 tons daily.

Another problem associated with the hot water method is the difficulty in re-using all the plant water. The major portion of the water contained in any bitumen and water emulsion must be separated before the oil is delivered to the refinery. The water from this separation step must eventually be stored, disposed of or recycled back into the process. Because this water contains bitumen emulsions, finely dispersed clay with poor settling characteristics and other contaminants, water pollution considerations prohibit discarding the waters into rivers, lakes or other natural bodies of water. Typical pond water assays from existing hot water processes contain up to 12% suspended solids, between 80 and 100% of which is fine clay of a size small than 2 microns. The pond water also contains about 0.1 to 0.5 weight percent bitumen. Because of the particular composition of the pond water, it cannot be discarded or to any great extent recycled back to the hot water process.

Most of the oil in the Athabasca oil sands is contained in fluviatile sand and fine grained well sorted sands. The basal member oil sands are composed of poorly sorted coarse grain sands, sand stones, and pebble conglomerates. The middle member oil sands are fine grained well sorted quartz sands, which are the richest oil sands and may be present in thickness of up to 220 feet. These sands can contain up to b 14% by weight or 28% by volume and then they are fully saturated with oil. The upper member of the oil sands is composed of thinly bedded horizontal sands and silts. These are often poorly impregnated with bitumen and commonly classed as overburden as mentioned heretofore. However, the upper member oil sands vary widely in sorting and grain size, bedding, and oil content and may contain an appreciable amount of oil in some areas. Thus, the stratification or bedding of the bituminous sands over much of its extent has been shown to be irregular and under normal circumstances saturated bituminous sand beds may be spotty, erratic and discontinuous. The oil sand deposits have much debris scattered throughout usually in the form of wood fragments, pebbles, iron conglomerates, siltstone lenses, shell beds, barren shales and very hard rounded stones of up to 6 inches in diameter composed of sand and clay cemented by pyrite. Thus, within the deposit are substantial lenses of low grade oil-sands containing 4 to 6% bitumen or less by weight, which are currently considered uneconomical to recover, plus other numerous zones and inclusions that are devoid of oil which include large beds of water sands, gas sands, barren shales, hard siliceous sandstones, clay beds, thin coal seams and siderite cemented lenses. It will be readily realized that in the open pit mining procedures now in commercial operation in conjunction with the hot and cold water methods of extraction, the oil sands together with all these inclusion are mined and passed to the extraction plant. This condition is undesirable to an extent that on frequent occasions due to the proportion of the inclusions in the particular oil sands being mined, the daily output of the extraction plant can be very irregular with its operation substantially curtailed.

Further, the natural state of the water-wet sand grains of the oil sands is a very fragile condition and if disturbed can cause irreversible conditions detrimental to the recovery of bitumen values. Mechanical handling is required in the conventional open pit mining technique and the hot and cold water extraction processes. The digging, conveying, mulling and pumping steps combined with the evaporation of water films from the sand grain surfaces during the exposure to air can often lead to a condition of oil-wet sand grains which decreases recovery and increases both oil and waste water contamination.

It thus will be readily realized that the conventional commercially operated extraction techniques for removing bitumen from oil sands are subject to many disadvantages and further are not utilizable for a substantial amount of the oil sands present for example in the Athabasca oil sand formation due to the depth of the sands, i.e., the extent of the overburden.

Deeply buried oil sands may of course be mined by underground mining techniques. However, such mined oil sands would be treated according to the conventional hot water and cold water methods for the extraction of bitumen therefrom and thus would be subject to the aforesaid disadvantages inherent in such techniques. Further, in such an underground mining method provision must be made for the adequate safety of both men and equipment and it is extremely difficult to maintain a conventional mechanical mining operation in which the mechanical equipment and the men are working directly within the ore body itself. The problems involved in scaling and supporting a roof and side walls against collapse or cave-ins in the unconsolidated oil sands containing such a multiplicity of vertical, horizontal and inclined bedding planes make such a procedure virtually impossible.

Proposals have therefore been made for extracting the bitumen from the oil sands by an in situ technique in which the oil sands are not removed from their location in the ground. However, such processes have heretofore not been found to be commercially useful.

The present invention provides a method of in situ extraction of bitumen from an oil sands body which is not subject to the disadvantages of the conventional and commercially operated cold and hot water extraction processes involving open mining of the oil sands body. This invention is operable under constant year around temperature conditions, provides for the economic recovery of hydrocarbons from the oil sands deposits, extracts bitumen values from the oil sands deposits at any depth of burial without disturbing the overburden, eliminates essentially all the mechanical problems caused by severe climatic conditions, maintains the natural water-wet condition of the oil sands until the bitumen values have been extracted, eliminates contact of the oil sands with unsaturated air and therefore avoids any evaporation of the water film on the oil sands, eliminates essentially all mechanical handling until the bitumen values have been extracted, is capable of selectively mining the irregularly bedded oil sands, provides for the separation of the oil-mineral-water fractions underground delivering separated oil to the surface as a hot liquid, provides for underground disposal of all silty and clayey waste products and provides for the clarification and re-use of process water.

According to the present invention therefore there is provided a method of in situ extraction of bitumen from an oil sands body which method comprises sinking an access shaft through the oil sands body, driving an access drift into the rock strata underlying the oil sands body, delineating a rectangular block of oil sands in said body by drilling and blasting the oil sands body to provide substantially vertical planes of fractured oil sands on all four sides of the enclosed mining room capable of retaining liquids and gases under pressure and comprising solid pillar walls, providing generally upwardly extending bores in the block of oil sands from the access drift in said body, providing perforated pipes in those portions of the bores in said block, the perforations of said pipes being dimensioned to prevent sand particles from said block passing therethrough, increasing the permeability of the block of oil sands within said room by fracturing said block, flooding the mining room with a hot fluid at a temperature for a residence time sufficient to raise the temperature of the block by an amount to cause the bitumen to become flowable with said fluid and removing the fluid bitumen mixture so formed from said block, the passage of fluid through said bed being via said perforated pipes and separating the bitumen from said fluid.

In the method of the present invention an access shaft is driven through the oil sands body and an access drift is driven into the rock strata underlying the oil sands body from which access drift a hot fluid and/or fluid bitumen mixture can be fed to and/or removed from the oil sands body. Thus, generally upwardly extending bores are drilled from the access drift into said body, the bores having disposed therein perforated pipes at least in those of the bores in the body and possibly also in those parts of the bores in the rock strata. However, the bore in the rock strata itself may act as suitable conduit for the passage of the fluids or fluid-bitumen mixture. The perforations in the pipes of course are dimensioned to prevent sand particles from the body passing therethrough. In the method of the present invention therefore, the hot fluid is introduced into the oil sands body in any suitable manner and desirably under pressure thereby to flood said body and remain therein for a residence time sufficient to raise the temperature of the body by an amount to cause the bitumen to become flowable with the fluid and the fluid-bitumen mixture so formed is subsequently removed from the body. In a particularly desirable embodiment of the present invention, the mixture of fluid and bitumen is removed from the body through the perforated pipes. The perforated pipes thus desirably constitute inter alia drainage pipes.

In order to prevent hot fluid introduced into said body for the purpose of removing bitumen therefrom from passing along said body inter alia through cracks and fissures thereby being lost to the process and also to allow for a desirable maintenance of high pressure within said body in the process of the present invention for the passage of liquid through said body, the body is delineated into a rectangular block of oil sands by drilling and blasting the oil sands body thereby to provide substantially vertical planes of fractured oil sands on all four sides of an enclosed mining room which mining room is capable of retaining liquids and gases under pressure and comprises solid pillar walls. Thus the present invention involves a room-and-pillar method of mining, the pillars acting as barriers between adjoining rooms. The overlying shale and underlying limestone strata serve together with the pillars to enclose a room containing a rectangular block of oil sands ready for fracturing suitably by blasting and for extraction with the hot fluid. It is also desirable, in order to allow for natural fractures and channels throughout the oil sands body including that portion which forms the pillar walls which permit leakage away from the mining room, of substantial amounts of valuable hot fluid, to line the inside of the pillar walls surrounding the mining room with a fence of suitably disposed drainage pipes which intercept any hot fluid that may tend to escape from the mining room through the walls. Further, by suitable blasting techniques oil sands areas surrounding this retaining fence of drainage pipes can be artificially fractured to collapse and destroy any natural fissures or channels in the pillar walls and provide a highly permeable zone of fractured oil sand around the drainage pipes through which any escaping fluid may find its way to the fence drainage system. By maintaining a lower pressure in the fence drainage system than in the mining room, a suitable barrier for escaping fluids is provided. A horizontal tunnel system directly beneath the drainage fence in the rock strata suitably forms a rectangle underneath the outer perimeter of the room and the tunnel system serves as an initial storage reservoir for the hot fluid, which hot fluid suitably after heat exchange to raise its temperature once more may be recirculated to the mining room suitably together with hot fluid and bitumen mixture withdrawn as desired from the mining room. To maintain a differential pressure between the fence drainage system and the mining room the former suitably discharges into a tunnel reservoir separate from that of the mining room. Suitably the fluid from the mining room discharges into tunnel reservoirs beneath the pillars on one pair of opposite sides of the mining room and the fence drainage system discharges hot fluid into tunnel reservoirs beneath pillars on the other pair of opposite sides of the mining room. For such a system the drainage fence is formed from vertically disposed drainage pipes on the pillars said other pair of opposite sides of the drainage room and the pillars on said one pair of opposite sides of the drainage room have suitably inclined bores. The tunnels may be on different levels and their functions may be reversed for subsequently removing bitumen from the pillars.

The object of the process of the present invention for the recovery of the bitumen from the oil sands is to increase the mobility of the cold, very viscous bitumen trapped in the oil sand body and this is achieved by extraction with a hot fluid. For this process to be successful, it is necessary to increase the permeability of the existing tightly packed oil sand body by creating fractures and channels within the oil sands body through which the hot fluid can flow to contact the viscous bitumen. Thus, a condition of fluffed up oil sands or well fractured rubble facilitates the dissipation of the hot fluid evenly through the oil sand body and ideal conditions for the recovery of the bitumen from the sand are achieved without ever moving the sand. Under such conditions the hot fluid can be forced through the porous sand body desirably under the influence of gravity and suitably under gas pressure. The fracturing of the block of oil sands in the room is suitably achieved by selective drilling and blasting of the oil sands block and these operations will normally be carried out from an access drift disposed above the body or from the access drift in the rock strata underlying the oil sands body depending upon the existing requirements.

In a particular embodiment thereof, the present invention provides for the use of explosives to selectively fracture and loosen the oil rich portion of the oil sands body and in particular without disturbing the underlying basal clay beds or low grade lenses of material interspersed throughout the deposits. This is achieved by suitable location of the charges in blasting bores drilled in the oil sands body which bores later serve for the passage of hot fluid into the body. Suitably a light gage liner is disposed in those sections of the blasting bores which pass through low grade upper layer deposits and/or through large lenses of undesired material which are not to be fractured by the explosives. This liner prevents the sloughing off of the side walls of the bore and also provides a means for communication of the hot fluid through the entire length of the holes during extraction of the bitumen with the hot fluid. Suitably, the explosive charges are capable of fracturing the oil sands body at predetermined radii of 2 to 30 feet or more. The blasting of the body to improve the permeability of the body and the blasting of the body to delineate the rectangular body may be combined and achieved at the same time. Alternatively blasting may be achieved by sequentially connecting perforated preformed pipes filled with gravel and swaged to interlock into each other. A porous plug e.g. a styrofoam plug acts as a temporary seal and will dissolve in the presence of petroleum oils. Prepacked explosive charges of selected capacity are inserted between adjacent tubes as desired and connected to a firing wire which wire is taped to the tubular storing being formed when required imperforate sections of tubes can be used or the perforated tubes can be taped over as required. The whole string is pushed or lowered by gravity into the bore hole, adding section by section. Before firing the bore hole is filled with water to increase the effectiveness of the explosive charges.

Exactly the same system may be used for the drainage pipes except that explosive charge and wiring are not required. Perforate or imperforate locking tubes may be raised into position with a hydraulic lift mechanism. Since the bore holes are several hundred feet long and the tubes reasonably flexible, natural distortion and friction holds the units in place. Taping can be applied as required.

In order not to waste tubing a non-locking section is used at the cross over point where the limestone meets the sand body and these tubes can be withdrawn after the main string is in place thus utilizing the natural bore in the rock strata.

In another embodiment of the present invention the fracturing of the oil sands body can be achieved by removal of substantial quantities of sand suitable by the use of stationary or rotating hydraulic jets located adjacent to the drainage pipe inlets. Removal of sufficient sand in this fashion can drastically reduce the blasting requirements as the sand masses will collapse and fracture under their own weight and blasting is only necessary to delineate the room and possibly to loosen the lower layers of the strata. Of course, this method involves the removal of sand from the room and this sand has to be disposed of. It may of course subsequently be partially returned to the mining room after removal of the bitumen values. Thus the richness of oil sand is inversely proportional to its clay content and the presence of a low clay content decreases the tensional strength of the oil sands. Thus, as the rich oil sands are normally found in the lower portion of the oil sand deposit, excellent caving characteristics can be expected in these low clay areas once a void has been created in the basal section of the room. Thus, the blasting is used to control the pillar walls and break the lower course of the oil sand deposit. Once the lower and side courses have been loosed by blasting and a suitable amount of sand has been removed by hydraulic sluicing, the central sand block of the mining room will collapse and cave under its own weight as oil sand deposits have little strength in tension. Adequate fracturing of the oil sand deposit in the room creates conditions which permit maximum recovery of the bitumen values. Therefore, in this embodiment of the invention for fracturing of the body, a portion of the rich oil sands which are normally the weakest and most readily minable portion of the deposit are physically removed for external treatment. Removal of this sand permits caving which creates fractures and voids in the remaining portion of the block in the room thus making it amenable to treatment with the hot fluid for recovery of the bitumen values. In the upper portions of the body where there are beds of siltstone, heavy clays of lean uneconomical oil sands, hydraulic removal of the sand in the lower zones is reduced to so as to minimize any disturbance of this upper area. The strata overlying the void are subjected to collapse at some point in time following the actual mineral removal. Thus, once the natural support is removed by mining the weight of the overlying strata is redistributed. Oil sands have little strength in tension and by selective blasting techniques vertical parting planes are created between the room and the pillar walls and the central mass therefore collapses under ideal conditions for caving into any void areas created by the hydraulic mining. The height and areal size of the void are important factors which influence the distance above the voids that breakage occurs. If sufficient void areas are created by hydraulic mining, breakage will extend upwardly through the block to the overlying shale roof. Breakage is a progressive reaction and if carried to completion results in the room being filled with loosened oil sand material capable of being penetrated easily by the hot fluid. If the upper portion of the oil sand deposit is composed of uneconomical oil sand, then sand removal can be reduced and the breakage is restrained to a lower level. In those cases where uneconomic beds of oil sands are overladen by richer oil sands then the degree of fracturing created is an economic decision. Of course not all of the oil sand in the room is extracted by hydraulic mining and a great cavity is also not created. Only sufficient oil sand is removed from the bottom of the room which will allow the remaining oil sand to fracture and collapse within the void areas created. In general from 10 to 30 percent removal of rich oil sands will create sufficient voids to induce full breakage. The remaining 70 to 90 percent of the block fractures by collapsing into the cavity so formed. Under such an arrangement, blasting requirements are drastically reduced and blasting of the oil sands body is limited to that necessary to delineate the pillar walls and initially loosen the bottom layer.

In the method of the prsent invention, a hot fluid is passed into the oil sands body in the mining room so as to flood the block to a desired level and the residence time of the hot fluid in the room is sufficient to raise the temperature of the block by an amount to cause the bitumen to become flowable with the fluid so that it can be removed as a hot fluid bitumen mixture from the room. The hot fluid may be suitably removed from the room via the perforated pipes, the perforations of which are dimensioned to prevent sand particles from the block passing therethrough. This means that the hot fluid will pass vertically and horizontally through the block to the perforated pipes which is desirable to achieve a maximum removal of bitumen from the block on each pass of the hot fluid through the block.

In one embodiment of the present invention, the hot fluid is introduced into the block from an access drift from the rock strata overlying the oil sands body, the hot fluid passes vertically and somewhat horizontally through the block under gravity and desirably under gas pressure to the perforated pipes which act solely as drainage pipes for the hot fluid bitumen mixture. The passage of the fluid through the block is facilitated by the bores in the block drilled for blasting the sands body inter alia to provide the room and also to provide for fracturing of the block. It will be readily realized that while the hot fluid passes through the block in one particular direction this path can be reversed to ensure that each end of the room will be contacted with fresh hot fluid and thereby improve recovery of the bitumen contained in the block.

In the method of the present invention, the hot fluid bitumen mixtures is desirably withdrawn from the block through perforated tubes. The use of perforated tubes for this purpose besides retaining the sand in the room, also provides for selective extraction of the bitumen from the bitumen rich portions of the oil sands block. In a particular embodiment of the present invention the pipe perforations are not continuous and are selectively placed to coincide with the oil rich portions of the oil sand body previously fractured by the blasting. Thus, the lower portion of the oil sand body resting on the limestone rock may be composed of underclays, barren sands filled with water or gases, gravels, coalseam or other unwanted material. A pipe passing through this unwanted material has solid walls and perforations do not begin until a suitable oil rich grade of sand has been reached. Generally, the drainage pipes are not perforated in those areas where they pass through substantial lenses of clay, low grade oil sand or other unwanted material which in turn has not been disturbed by blasting. Again since much of the upper portion of the oil sand body consists of low grade uneconomical sands, the tops of the perforated pipes which are closed may present an uneven profile as they follow the bottom of the deposits. Thus, by use of the perforated pipes according to the present invention, selective mining of very irregularly zoned oil sand deposits and the rejection of low grade sands and unwanted debris by a combination of proper drainage pipe design, controlled hot fluid flooding levels and selective blasting techniques may be achieved. The pipe perforations may be of any suitable shape and size and/or the pipe may be packed with coarse graded sand, glass beads, steel shot, walnut shells and the like of a size small enough to retain within the oil sands body all pebbles, siltstone lumps and other hard insoluble unwanted debris. Thus, the drainage pipes with properly spaced holes are placed throughout the room and the sand formation between these pipes subsequently fractured by blasting.

A particularly suitable drainage pipe is constructed out of rolls of expanded metal on location underground. This expanded metal tube is wrapped with a strong protective wrapper as it comes of the mandrel of a machine and removal of selected portions of the wrapper as the pipe is being fed into the drilled bore accomplishes the desired interrupted spacing of the perforations to attain the desired rate of flow of the drainage system. A wooden nose plug is attached to the leading end of the pipe to facilitate its passage up the drilled bore hole. By drilling the hole oversize and by increasing the expanded metal overlap whenever it is required to strengthen the pipe, a complete length of drainage pipe can be formed and slid into place, which pipe is cheap enough to be left in place after the bitumen has been extracted from the block in the mining room. Suitably, guide shoes may be attached to the pipe at every twenty to thirty feet to aid its passageway into the drilled bore into position.

In a particularly desirable embodiment of the present invention, the hot fluid is a hot liquid. The hot liquid is suitably introduced into the oil sand block so as to flood the room to a desired level. In a particular embodiment of the method of the present invention, the mining room is separately pressurized with an insoluble gas to maintain flexibility of control of the level of flooding therein. In particular, by controlling the gas pressure in the mining room the level of flooding within the room can be limited, the rate of flow of the liquid through the drainage pipes can be controlled and the transfer of the liquid through a system of conduits or passageways from the room to a separation zone can be effected.

By adjusting the rate of liquid flow out of the room by variation of the pressure, the level of liquid flooding within the room can be controlled at any desired height which ensures maximum liquid contact with the sand in the block and minimzes the effect of channelling. Furthermore, the ability to flood the room provides operational flexibility in that the room can function as the storage reservoir or be called upon to supply extra liquids to satisfy the downstream needs of the process. This non-mechanical movement of the liquid ensures minimum agitation of the liquid during extraction of bitumen from the body and tends to preserve the natural state of the water-wet sand grains. As aforesaid, the natural state of the water-wet sand grains is a very fragile condition and if disturbed can cause irreversible conditions detremental to the recovery of the bitumen. Alteration of the physical configuration tends to result in some oil wetting of the sand grain, which in turn results in contamination of the liquid with additional solids and water present.

The process of the present invention thus provides, in addition to fracturing of the oil sands body with selectively placed explosives, a system of perforated pipes which ensure rapid means of filling and/or draining the room to provide easy passageways through which the liquid can pass. Thus, capped perforated pipes are placed in the holes drilled in the oil sand room from an underlying access drift in the rock strata. These holes are drilled and the perforated pipes placed into position before the intervening oil sand body is fractured by explosive blasting. It is only necessary that the portion of the drilled hole within the oil sand body and the short upper section of the limestone rock be lined with the pipe as in the lower portion the drilled hole within the limestone rock itself will provide an adequate conduit for the liquid.

Displacement of the liquid through the perforated pipes takes place under the effect of the gravity head and room gas pressure. If the pipes are evenly perforated per lineal foot and the permeability of the body is uniform, the flow of liquid is greater in the lower zones of the oil sand body. Thus, since the correct degree of pipe perforations is a function of the gas pressure, gravity head and the artificially created permeability of the surrounding oil sands, it is desirable that these pipe perforations are varied to ensure that it is the upper zones of the oil sand body that enjoy a higher rate of liquid flow thus enabling the progressive depletion of the oil sands deposits from the top down.

As the bitumen content of the upper portions of the oil sands body is depleted, the level of flooding in subsequent cycles is desirably reduced and unnecessary washing of the depleted zones is thereby avoided. This is particularly beneficial with low grade oil sand zones in the upper sections of the deposits which are composed of layers of oil sand interspersed with poorly impregnated layers of material containing abnormal amounts of clay and silt. By instituting a limited number of full flooding cycles in the room and then lowering the level of flooding, readily available bitumen can be "high graded" off in these low grade oil sand zones and at the same time avoid disturbing the bulk of the clay and the silt present in these zones.

A variety of hot liquid flow patterns can be utilized in the method of the present invention. In particular, hot liquid can be forced up through the drainage pipes located in the body to fill the cracks and crevices in the body until a desired pressure or level of filling is reached. A portion of the hot liquid aided by the gas pressure then drains down through the drainage pipes into tunnel storage areas. As the hot liquid increases in bitumen content a portion is removed as oil product and replaced with fresh hot liquid.

An alternative hot liquid flow pattern is to force the hot liquid continuously down through the holes that were used for blasting and practically all of the liquid must travel laterally through the block in order to reach the perforated drainage pipes and thus a minimum amount of mineral material will accompany the fluids as they pass through the block.

A reverse liquid flow pattern can be used in which the hot liquid is forced upwardly through the drainage pipes, laterally through the block and out of the mining room through the drilled blast holes. This flow pattern has the advantage that minimal accumulation of sand occurs in the reservoir beneath the oil sands body, that the flow of clean hot liquid upwardly through the drainage pipes into the sand deposit keeps the pipe perforations from plugging, that the liquid bitumen mixture flowing laterally upwardly through the porous body is substantially free from mineral content and that gravity aids in settling out the mineral particles and any droplets of water. However this flow pattern has the disadvantage that the entire block must be completely filled with liquid during the whole extraction and the advantage of gravity flow is lost; the lower grade upper sections of the block which have the lowest permeability will have to pass the entire liquid volume through its pores and the higher grade lower oil rich sands of the block tend to receive minimum contact with the liquid and thus minimum washing cycles. Since much of the upper portion of the body is composed of low grade deposits, as aforesaid, continual washing of these areas with high grade liquid is a disadvantage.

A third alternative hot liquid flow pattern is to force the hot liquid through the drainage pipes from one side of the room and then force the liquid laterally to drain out of the drainage pipes on the opposite side of the room. This requires a much greater lateral travel distance of the hot liquid in the block and has the advantage of being able to operate the method at any desired level of flooding within the room. This advantage is particularly useful in those deposits where the richer oil sands are located in the lower sections of the body. At various stages one of the above flow patterns may be used or patterns similar thereto.

In a particular embodiment of the present invention the hot liquid is a water-immiscible low-viscosity organic solvent for the bitumen which solvent is desirably anhydrous. In order that the extraction is commercially useful with such a solvent, it is however necessary that the solvent be recovered substantially completely because the solvent employed is usually worth much more than the bitumen recovered. The problem of solvent recovery is magnified because the sand in the block represents so much of the material that is worked and even small percentage losses of solvent in the discarded sand cannot be commercially tolerated. Solvent extraction of the bitumen from the oil sands body involves contacting the oil sands with the solvent to produce a liquid phase of the solvent and dissolved bitumen and a solid phase of sand and then the liquid phase is separated from the solid phase and subsequently the bitumen is recovered from the solvent.

Bituminous sands may be regarded as essentially a compacted mass of water-coated sand particles held together by bitumen which forms a film around each particle. The water immiscible low-viscosity organic solvent, e.g. a light oil having the properties of naphthalene may be heated to form a warm solvent and upon contact with the oil sands, the bitumen fraction dissolves in the solvent forming a compound oil of a specific gravity of less than one, at the same time having a very low viscosity. Thus, in a particularly preferred embodiment of the present invention, the heat of the solvent as well as the dissolving capabilities of the solvent are used to increase the mobility of the bitumen in the sand. The method is normally effected at a low temperature, well below the boiling point of water and usually in the range 90° to 130° F so as to preserve the interfacial skin tension between the water coated sand particles and the liquid hydrocarbon and thereby minimize the co-removal of water from said block with said bitumen by said solvent. The entire process desirably takes place under gas tight conditions which ensures the recovery of the gaseous phase or light ends of the hydrocarbon values. The gas tight conditions are maintained by utilizing the existing rock strata as conduits and pressure vessel containers in which can be moved, stored or processed under desired conditions of pressure and temperature, the slurries, liquids and gases involved in the process. Thus, in this embodiment of the present invention the low temperature solvent, which is immiscible in water, is forced under pressure into the cracks and fractures within the body, the warm solvent moving at a relatively low velocity extracts the bitumen without breaking the liquid film on the water envelope surrounding the sand particle and without disturbing the water filled clay lenses that are prevalent throughout the formation. As the warm solvent only removes bitumen, it is only effective on rich bitumen impregnated sands and by-passes to a large extent the low grade shaly clay containing portions of the body. There is of course some loss of heat into these low grade lenses, but this is restricted to the surface areas and tends to be proportional to the ability of the warm solvent to penetrate the deposits. The ability of the solvent to penetrate, in turn, is proportional to the grade of the oil sand and to some extent to the degree of fracturing created by the blasting. The extraction depends upon the transfer of heat to the cold (40° F) oil sand through which the warm solvent, which is itself not over 130° F, passes. This narrow temperature differential generally requires the solvent to be cycled, reheated, and then recycled many times through the block in the early stages of extraction. As the internal cavities increase in the block, the volume of liquid per cycle increases until a point is reached when a portion of the liquid containing a suitable percentage of dissolved bitumen can be diverted from the recycling to a product oil line and replaced with fresh solvent from a refinery.

In a particular embodiment of the present invention using the solvent extraction technique, as the depletion point of the bitumen in the block is being reached and the block has become more porous and has fully increased in temperature, the temperature of the incoming warm solvent may be increased until there is initial evidence of interfacial breakdown of the water envelopes on the sand particles by the presence of increased water content in the flow of the bitumen-solvent mixture from the block. This increased temperature facilitates removal of the depleted bitumen from the block.

In the process of the present invention using the solvent extraction technique, the pressurized underground solvent storage reservoir may be formed in the overlying rock strata. Thus, pressure developed within the reservoir plus the gravity head will be sufficient to deliver the solvent to the block without the use of mechanical pumps. This reservoir may be provided with a decanting arrangement to remove the solvent bitumen mixture and with a spigoting arrangement to remove settled water and fines. The reservoir may also be fitted with a heat exchanger to maintain the solvent at a desired temperature. Recycled solvent from the block and fresh solvent from surface are fed to the reservoir and by dividing the reservoir into separate compartments solvents containing varying concentrations of dissolved bitumen can be stored separately for more efficient use in the operations.

The solvent extraction process of the present invention is essentially a displacement of a highly viscous liquid bitumen with a low viscosity liquid, namely the solvent, and at the completion of the extraction of the bitumen the block will still be flooded to a large extent with diluted solvent. Substantially all of the solvent must be recovered if the extraction technique is to be economically viable.

In accordance with a particular embodiment of the present invention the solvent recovery from the block is accomplished by steam-sweeping the block or sweeping the block with steam laden hot air until substantially all of the solvent has been recovered. By using hot air or low temperature steam at low velocities the solvent can be distilled off at about 150° F while the liquid envelopes that encase the sand particles are preserved intact. When the liquid water envelopes are fractured there will be a substantial increase in the heat requirements while a substantial quantity of water and clay has to be disposed of. Further, the temperature of the stripping gases can be increased progressively as solvent recovery drops until there is evidence of breakdown of the water envelopes by the presence of increased water content in the recovered solvents.

The recovery of the solvent may also be accomplished by passing hot flue gases through the depleted porous block and these hot gases can be delivered from the surface or can be created underground by combustion in a sealed passageway above the mining room. Low grade hydrocarbon waste products from the refinery can be burned with excess air to form controllably heated flue gases in the passage way and the resulting hot gases may be forced down through the drilled explosive bores and down through the depleted porous sand block. These warm gases evaporate the low boiling solvent and they exit through the perforated pipe system into the lower passageways where water cooled condensers or sprays will convert the bulk of the gaseous solvent in a liquid form which is then recycled. The residual flue gases are passed to the surface for final scrubbing before discharge.

An alternate source of fuel is the low grade bitumen deposits present in the upper layers of the oil sand body which may be ignited to create the desired hot flue gases. This system is howevermore difficult to control and may result in the combustion of a portion of the desired solvent as well as possibly reaching local temperatures that may destroy the water envelopes and therefore increase the quantity of connate water including the entrapped fines. Such a condition tends to plug the pores of the block, and restrict the recovery of the solvent from the block.

In the solvent extract procedure, because the entire recovery is desirably in a closed pressurized circuit, it is possible to use low boiling point solvents such as gasoline or even liquified petroleum gases all of which are effective diluents and are easily recoverable during the solvent stripping stage. Alcohols may also be used.

It is well known that liquified petroleum gases or light oils, with boiling points in the range of 70° to 150° C, which are saturates of aliphatic composition, are capable of dissolving the oil portion of the bitumen to form a combined oil of substantially lower viscosity. These aliphatic liquids leave untouched the major proportion of the undesirable asphaltenes which are insoluble in the extraction solvent of saturates and which tend to remain deposited on the sand particles in the block. The asphaltenes represent about 20% of the bitumen by weight and the remaining 80% of the bitumen is a maltene portion which is composed of the oily constituent of the bitumen. In the maltene portion approximately 25% of the oil are aromatics which are capable of dissolving the asphaltenes.

The use of the light oily mixture containing a high proportion of saturates, such as naphthenes or straight run gasoline, selectively dilutes the oily portion of the bitumen and produces a combined oil of lower viscosity which contains some aromatics. When the aromatic content of the recycled combined oil is about 20%, the oil is removed as product oil and replaced with fresh solvent. By the use of such solvents, approximately two thirds of the asphaltenes remain in the body and only one third are extracted in the product oil. This is desirable as the asphaltenes are costly to remove in the refinery from the extracted bitumen and their sulphur content is approximately double that of the oily portion. Major proportions of the asphaltenes can be left in the sand block by the use of liquified petroleum gas such as propane or butane as the extraction solvent. This method is practical as suitable pressure containers are provided in the rock formation which are capable of withstanding pressures of up to 600 psi which are necessary to keep the gases in liquid form during the extraction cycle. Solvent recovery is easily achieved by reducing the pressure and allowing the solvent to come off as a gas followed by an airsweep. The above two methods can be combined by using the light oil hydrocarbon mixtures to remove the bulk of the oily constituents followed by a wash cycle of liquified petroleum which in turn is followed by an airsweep to complete the cycle.

In using the solvent extraction technique, the bitumen solution removed from the body is allowed to settle in a pressure vessel whereby any water and sand present in the solution is separated therefrom by decantation and the solvent removed from the bitumen by flash evaporation by releasing the pressure in the vessel, the solvent being condensed and recycled to a reservoir from which the room is flooded therewith.

In a particular embodiment of the solvent extraction process of the present invention, the solvent is heated to a much higher temperature which will break down the liquid water envelope surrounding the sand particles in the block and the sand particles are flushed from the block together with their fines. While this procedure initially will produce a dirtier product oil, it greatly speeds the rate of recovery and in practice this initial step may be used until about 20 to 30% of the bitumen has been removed leaving substantial cavities in the block. At this point in the process the temperature of the solvent is reduced so that the remaining liquid water envelopes remain intact and the cleaner more desirable oil is obtained from the block.

In another embodiment of the present invention the hot liquid is hot water which is fed into the room at a high temperature and at a high pressure to form an emulsion of water and bitumen which is removed from the roomm through said drainage pipes. In such a process a pressurized underground hot water storage reservoir is formed in the overlying rock strata where makeup water, steam and other reagents from the surface can be added and mixed and passed to the mining room. Gas pressure developed within the reservoir plus the gravity head is sufficient to deliver the hot water to the block without the use of mechanical pumps, the reservoir being provided with a decanting arrangement to scavenge any floating residual traces or oil and a spiggoting arrangement to remove any accummulation of settled minerals. The circulating hot water may have emulsifying additives or surfactants or pH additives therein as may be required. Thus, in the process using hot water as the hot liquid, the hot water suitably at a temperature from 300° to 500° F under pressure is passed into the mining room and forced into the fractures of the body to contact the cold bitumen according to one of the flow patterns described heretofore. The recovered liquid is a hot oil-water emulsion containing some fine material. The quantity of mineral removed from the emulsion depends to a large extent on the areal extent of the openings in the drainage pipes and their size and shape as well as the velocity of the emulsion passing through these openings. The velocity of the oil-water emulsion may be controlled by the gas pressure maintained in the mining room, the area of the pipe openings and the black pressure of the water in the passageway into which the drainage pipes discharge. In the process each room is individually pressurized with an insoluble gas to give flexibility of control and by this means it is possible to maintain the aqueous liquid at elevated temperatures or release steam within the room to produce localized agitation and rupturing of the films on the sand particles through a boiling action or control the level of flooding within the room or carry out the transfer of the liquid emulsion from the room to a sand extraction zone and subsequently through an oil-water separation zone without the use of mechanical equipment. The gas pressure may also be used to control the rate of flow of oil-water emulsions through the pipe drainage system and aids in resisting the overburden loads as roof stresses change during the extraction procedure.

The superheated hot aqueous solution suitably at a temperature from 300° to 500° F is permitted a suitable residence time for the heat to dissipate and penetrate the block in the room which will result in an overall drop in the temperature of the solution and a subsequent temperature rise on the interfacial surface layers of the oil-sand in contact with the hot aqueous solution. The lowering of the room pressure at frequent intervals below the vapour pressure of the liquid results in a small release of steam. The heated water film surrounding the sand grains tend to vapourize and rupture the bitumen envelope and the boiling action results in the creation of minute fractures at the interface between the hot liquids and the oil sand block thus exposing fresh layers of unheated oil sand. The sand particles remain water-wet while the bitumen forms a hot liquid oil-water emulsion of low viscosity which may be displaced out of the oil sand body under gravity and gas pressure. Essentially all of the oil-water emulsion travels laterally through the body in order to reach the perforated drain pipes. When the velocity of this liquid movement is kept at a very low level, a minimum amount of mineral material will accompany the draining liquid as the preferentially water-wet silts and clays will tend to adhere to the water-wet sand particles in the block. By this process the natural water-wet condition of the mineral fraction in the block is maintained and there is no violent agitation whereby mineral matter can be made oil-wet mechanically. Further, there is no opportunity for evaporation of water from the mineral surfaces to occur which would permit an oil-wet sand condition to form. As aforesaid in discussing the prior art process, this condition is undesirable and reduces the recovery of the bitumen.

Further, by utilizing a higher velocity of liquid inflow during the flooding of the mining room, the intersticies of the sand particles near the pipe perforations are swept clean of any deposited silts and clay and high permeability of the sand block near the perforated pipes is maintained during subsequent draining cycles. Liquid cycling operations are continued until the recovery of the bitumen values drops to an economic cut off point. To ensure the maximum recovery of the bitumen, suitable surface active agents and/or pH controlling reagents are added to the hot water during the flooding cycle which tend to improve the yield by decreasing the interfacial tension between the bitumen and the water. The greater the degree of fracturing and subsequent agitation by ebullient boiling, the lower will be the number of constrictions in the pore channels of the block and therefore the higher the recovery rate.

As with the solvent extraction technique, as the bitumen content of the upper portion of the oil sands body is depleted the level of flooding in subsequent cycles can be reduced thereby avoiding unnecessary washing of the depleted zones.

In a particular embodiment of the present invention the residual block in the mining room after removal of the bitumen is a heated block and the heat values may be recovered by flooding the block with cold make-up water. This recovery of heat values from the depleted block requires a very low velocity of liquid flow during drainage in order to minimize removal of clay of silt from the interstices of the sand block and to provide a residence time for the transfer of heat. Following the removal of the heat value the block may be used as a pressure sand filter for the removal of silt and clay from the waste water which is separated from the oil in a subsequent separation step. Thus, the method of the present invention using a water extraction technique provides for the underground disposal of the silted waste products in a depleted block and the subsequent recovery of process water by utilizing the depleted block as a pressure sand filter. Of course the recovery of heat values and the clarification of the water may be combined into a single step. By forcing the contaminated separated water through the residual porous block, a substantial portion of its fines content can be removed through some portion of −2 micron size clays will be carried through with the drainage water. This carryover can be minimized in accordance with the process of Canadian Pat. No. 926,885 by the addition of water-soluble high molecular weight polymer as fines retention agents.

In a further embodiment of the present invention, the water extraction technique is modified by the presence of a preferably water-immiscible organic solvent for the bitumen. It has been found that the presence of such a solvent, for example a petroleum distilate, at a solvent-bitumen ratio of about 1:1 by volume in the water increases the recovery of bitumen values and lowers the required liquid phase feed temperatures to the block to about the 200° to 300° F range with the oil-water emulsion liquid being recovered in the range 100° to 150° F. Thus, the loss of some solvent can be compensated for by a lower heat requirement. The solvent may be a liquid hydrocarbon solvent preferably a hydrocarbon solvent boiling in the range 100° to 400° F, suitable examples of which are coker naptha and gasoline. Because the entire process is in a closed pressurized circuit, it is possible to use low boiling point solvents such as gasoline or even liquified petroleum gases all of which are very effective solvents and are easily recoverable during the solvent stripping stage.

Separation of both water and mineral solids from the bitumen is necessary for most ultimate uses of the bitumen such as upgrading in conventional refining operations. In the process of the present invention the formation of froth is avoided at all stages by the use of pressure vessels located underground in the limestone strata to carry out the oil separation step in the conditions of elevated temperature and pressure within a closed circuit.

In the method of the present invention using hot water extraction, the very hot 400° to 500° F water circulating through the block reduces the viscosity of the bitumen to form an oil-water emulsion which at about 300° F will have a viscosity about equal to that of water and a bitumen content of about 30%. To this emulsion is added a solvent at a solvent-bitumen ratio of about 1:1 by volume to dissolve the bitumen particles and to form a combined oil. The diluent or solvent, which is desirably a petroleum distilate, is suitably added to the emulsion as it leaves the mining room and is mixed during passage of the emulsion to a sand separator. The diluent can be a liquid hydrocarbon solvent such as coker naphtha having a boiling range of 100° to 400° F and further a demulsifying agent is desirably added thereto to lower the interfacial tension between the bitumen and water particles. Of course, when the hot water contains a solvent then there is no need to add further solvents on exiting from the mining room. However, a demulsifier is added and it is heated to about 300° F to prepare it for separation.

In a particular embodiment of the present invention in the water extraction method with or without the solvent, the emulsion is withdrawn from the room and passed to a sand separator at high temperature and under high pressure and at a velocity sufficient to maintain the sand particles of less than 100 micron size in suspension. The sand particles over 100 micron size are separated in said separator. The emulsion is passed from the sand separator to an oil-water separation chamber. The diluent is added to the emulsion after leaving the room and before passage to the separation chamber in an amount sufficent to form a combined oil of density less then 1. The oil, water and fine sand solids are allowed to separate under gravity settling, under conditions of high temperature and pressure, the fines solids are removed as a sludge, at least part of the water is removed from the separation chamber, and the bitumen is removed from the separation chamber as a fluid under pressure as hot liquid for passage to the surface for refining. In a particular embodiment of the invention, the diluent is added to the emulsion as it passes from the sand separator to the separation chamber. Alternatively the diluent may be added to the emulsion as it passes to the sand separator. Desirably a back pressure is maintained in the separation chamber to provide for non-turbulent removal of bitumen from the separation chamber and the subsequent filling up of the separation chamber with further emulsion for separation. Suitably the sand is removed from the sand separator and passed to a drying vessel where it is flash dried by reducing the pressure in the drying vessel. The water separated from the emulsion is desirably recycled to a reservoir for further flooding of the mining room. As aforesaid recycled water or fresh water for flooding the mining room is suitably heated by passing through the sand block of a mining room from which the bitumen has been previously exhausted and recycled water can be clarified by slow passage through the block in the mining room from which the bitumen has previously been exhausted.

The method of the present invention offers the desirable possibility of utilizing the underground strata as a pressure vessel thereby allowing an oil-water mineral separation step under elevated temperatures and pressures with large volumes of liquid. By the use of underground rock to contain the gas and liquid pressures, it is possible to construct very large pressure vessels at an economical cost and operate those high pressure vessels under safe conditions. It is this possibility of containing the pressure by the surrounding rock that makes it economically possible to produce a multiplicity of large vessels, whereas to duplicate the same arrangement on the surface would render the process extremely expensive and economical undesirable. To achieve maximum quiescence and to permit prolonged settling periods of up to 24 hours or more, the separation is preferably conducted as a batch process. Thus, the oil-water separation step takes place in a quiescent zone by carrying out the process on a batch basis in a multiplicity of pressure chambers. The oil, by virtue of its lower specific gravity, will rise to the top of the chamber while the mineral fines in the heavier water will occupy the lower portion of the chamber. Settling periods of up to 24 hours or more are possible. The combined oil is decanted off and sent to the refinery as a hot liquid where the solvent is recovered by distillation and returned to the process. Separation of the water from the bitumen requires a solvent addition and the inclusion of a de-emulsifying agent to provide essentially complete separation. The hot water is steam flashed by dropping the pressure to recover any residual traces of solvent and the water then pumped as a hot liquid to the hot water storage reservoir. The settled mineral slimes may be disposed of by pumping them to a depleted porous sand bed.

In the solvent extraction method, the cooled 90° to 100° F solvent bitumen mixture exiting from the room and passing to a separator for the separation of sand thereof suitably has an emulsifier added and is heated to about 300° F in preparation for the settling of the sands.

It will thus be seen that in a preferred embodiment of the present invention the conduits, pressure vessels and storage vessels are all formed from the rock strata, which is highly desirable both economically and for efficency for example, the pressure storage reservoirs from which the liquids can be added to or removed from the mining room may be created by blocking off the ends of both the overlying or underlying access drifts. Further the pressures and flow of fluids in the process are provided primarily by gravity and gas pressure which again is desirable both economically and commercially.

In a further embodiment of the present invention the hot fluid may be a hot gas such as steam, air, carbon dioxide, nitrogen or flue gases which are heated externally and then forced into the mining room. These hot gases moving through the block in the mining room liquefy and partially gasify the bitumen in the oil sands block and carry the liquid and gaseous products to the perforated pipes for recovery. The flue gases can be heated on the surface but preferably are heated in a sealed upper access drift which is utilized as a combustion chamber. In the combustion chamber a suitable fuel is burned to produce a large volumen of hot flue gas under high pressure. Such fuels include waste refinery products, liquid pitch, coal and pulverized coal.

It is clear that in the method using hot gases these hot gases can be produced without the use of heat exchangers and the products of combustion can pass directly from the combustion chamber into the prefractured block through the existing bore holes. The use of high-ash containing fuels may be limited to the latter stages of recovery in order to prevent early blocking of the passageways in the block.

The present invention will be further illustrated by way of the accompanying drawings in which.

Figure 1:
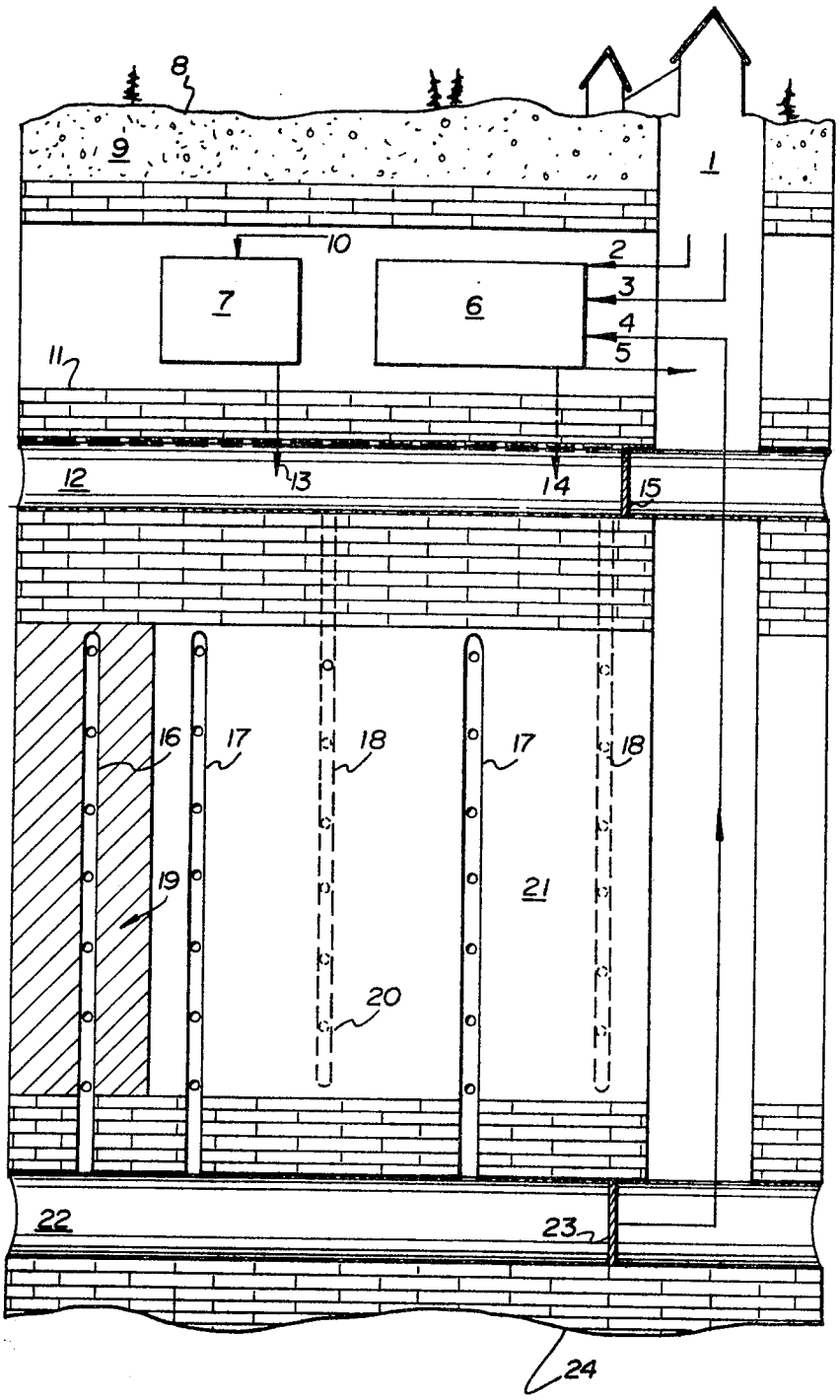
FIG. 1 is a schematic vertical section through parts of an oil sands deposit showing the method of in situ recovery of bitumen from oil sands according to a preferred embodiment of the present invention.
Figure 2:
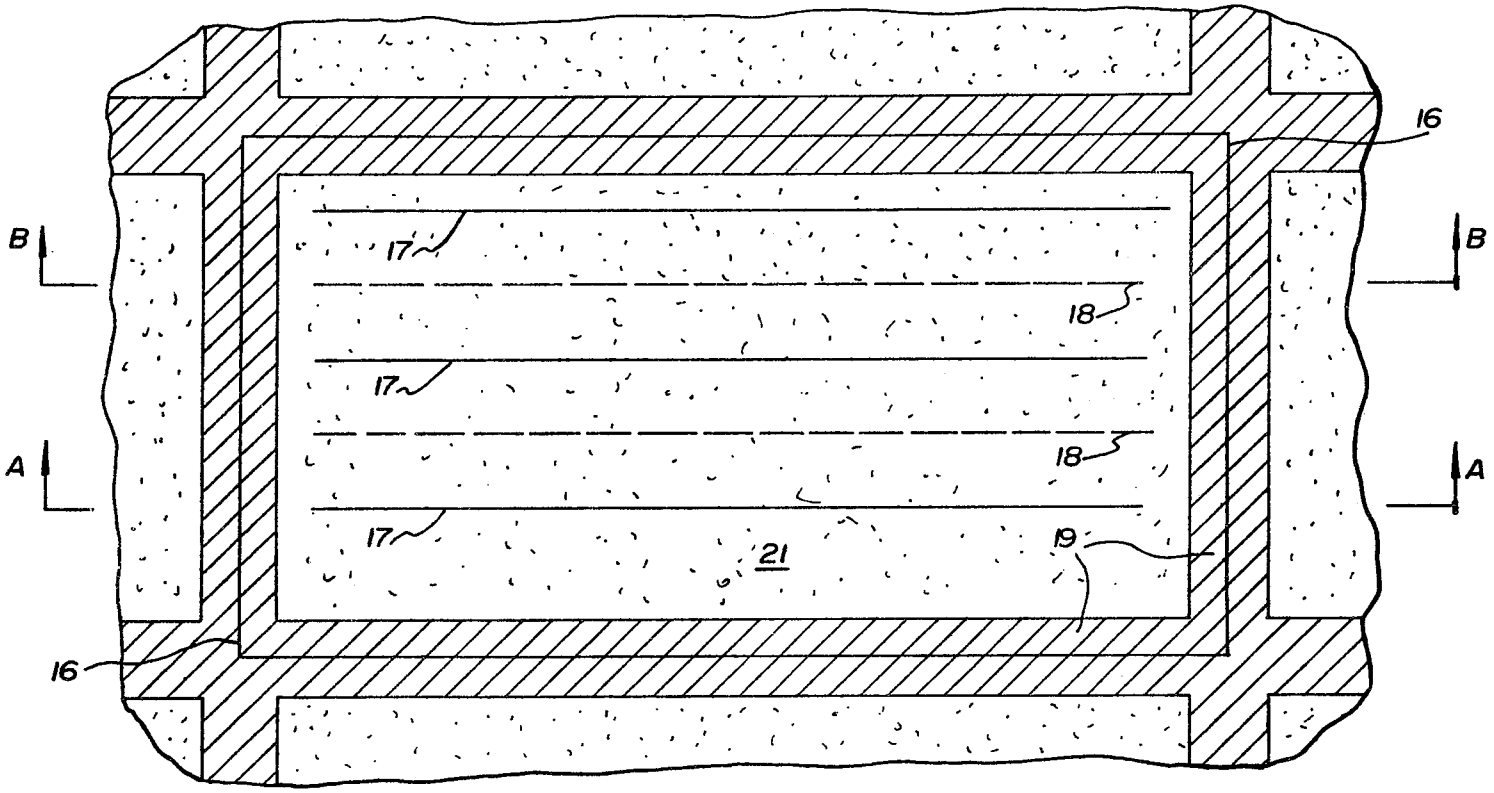
FIG. 2 is a plan view of the oil sands body showing the room and pillar method of separation thereof.
Figure 3:
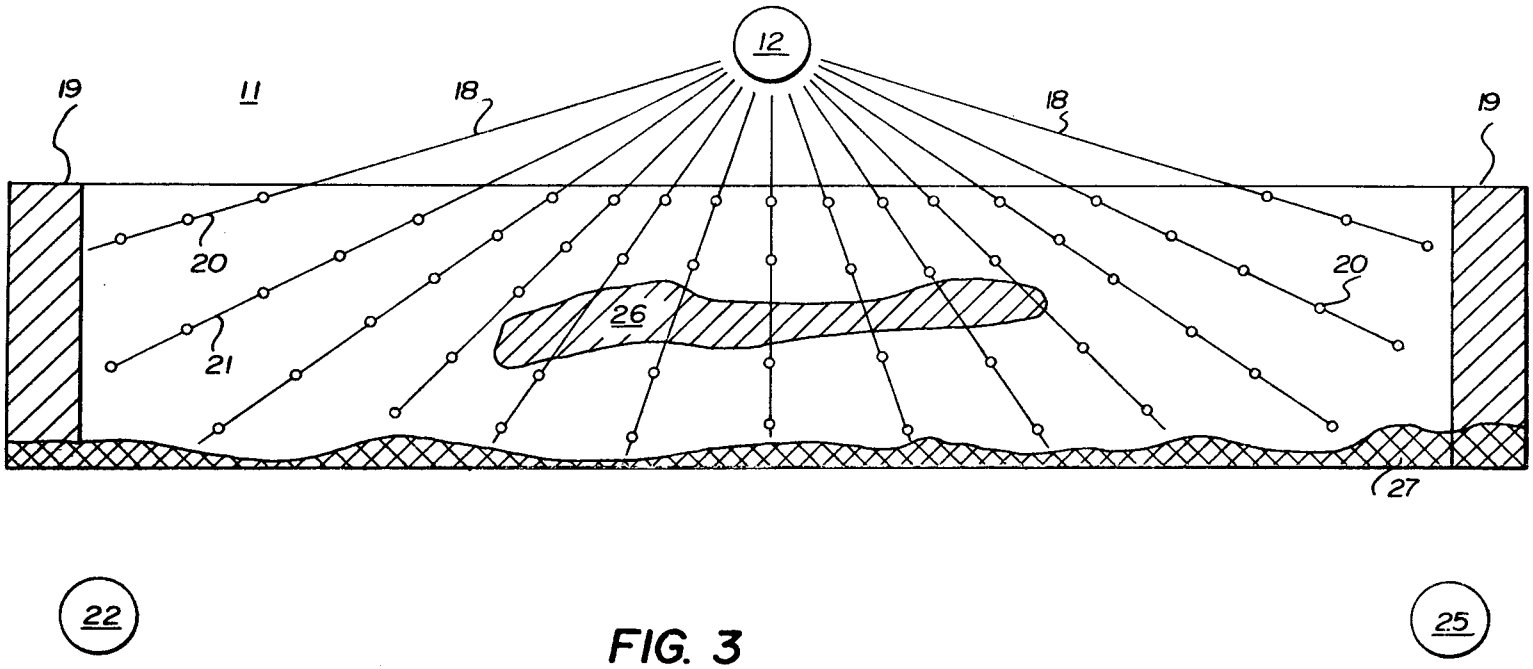
FIG. 3 is a schematic section taken along the line B—B in FIG. 2 showing the disposition of the bores holes and the explosive charges for selectively fracturing the block in the mining room in FIG. 2.

Referring to the drawings, and particularly to FIGS. 1, 2 and 3 an access mining shaft 1 is sunk through muskeg 8, glacial till 9 overlying shale rock 11 and oil sands deposits 21 into the underlying limestone rock 24 using conventional mining techniques.

From this vertical shaft 1 are driven horizontal access drifts which are working tunnels or passageways. One access drift 12 is driven above the oil sand deposit 21 in the shale rock 11 and horizontally spaced access drifts 22 and 25 (FIGS. 3 and 4) are driven in the limestone rock 24 below the oil sands deposit 21. These horizontal access drifts 12, 22 and 25 can be bored in the limestone by tunneling machines using conventional mining methods.

A pressurized liquid storage reservior 6 and a compressed air reservoir 7 are formed directly in the overlying shale rock 11, the reservoir 6 being equipped with heat exchangers (not shown) so as to raise the temperature of liquid therein. Liquid is fed from the surface to the reservoir 6 via line 2. Steam to heat the heat exchanger (not shown) or added directly in the reservoir 6 is fed via line 3 and the reservoir receives recycled hot liquid via line 4. Pressurized air is fed to the compressed air reservoir 7 through line 10.

Figure 4:
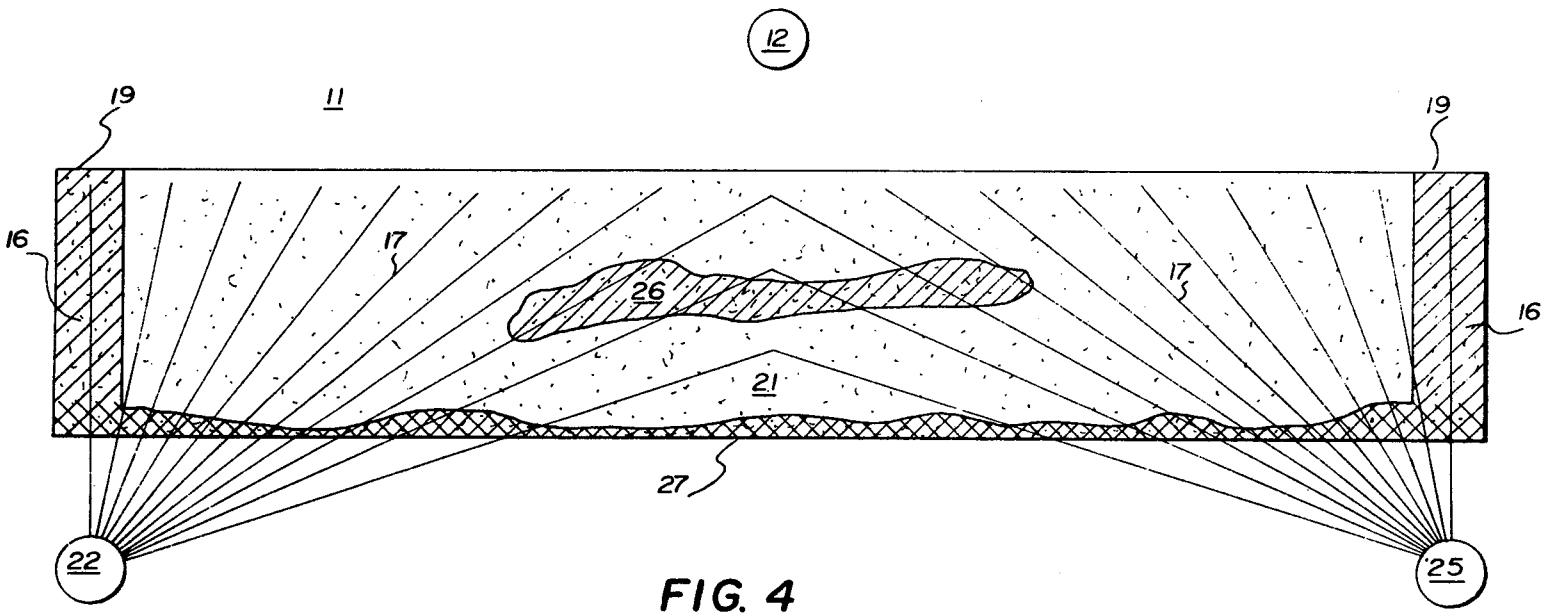
FIG. 4 is a section taken along the line A—A in FIG. 2 showing the disposition of the drainage pipes in the block in the mining room in FIG. 2.

Referring particularly to FIGS. 2, 3 and 4 from the access drift 12 drilled holes pass through the overlying shale rock 11 into the block of oil sands 21 contained within the pillar wall 19 of the mining room. Explosive charges 20 which can vary in blasting capacities are placed in preselected positions in the drilled holes. In particular, from the material obtained from the drill hole the composition of the various levels of the block through which the drilled holes pass is ascertained and from this information the size of the explosive charge and its location are determined. Thus for example the basal underclays 27 and low grade material 26 are not to be disturbed and explosive charges are not placed in these zones. By this method selective fracturing of the oil sand deposit 21 takes place and the pattern being repeated at regular intervals along the full length of the access drift 12. The pillar walls 19 of undisturbed oil sand are created by avoiding explosive fracturing of the oil sands in these areas. Thus by selective blasting it is possible to produce the mining room in the oil sands 21 enclosed by the pillar walls 19. Further, the block of oil sands 21 in the mining room is fractured in a selected manner.

Before such fracturing light weight metal or plastic pipes 17 which are capable of some bending or deforming without breaking are placed into a series of holes drilled into the oil sands deposit from the passageways 22 and 25. These pipes are finely perforated and wrapped in a plastic tape. The rate of liquid flow into the pipes 17 at any given elevation is substantially controlled by the area of exposed perforated pipes in the section passing through the given elevation. The degree of perforated pipe exposure at any given elevation is determined by the amount of plastic tape wrapping that has been removed from the pipe 17 during installation. In the basal underclay area 27 and the low grade material area 26 tape covering on the pipe is left intact and the pipe in these areas is essentially imperforate. Also, no pipe is required in the underlying limestone as the drilled holes for the pipes act as satisfactory conduits to the drifts 22 and 25. Selective draining of the oil sand block 21 thus takes place with the pattern being repeated at regular intervals along the full length of the passageways 22 and 25. A special fence of drainage pipes 16 is located within the pillar walls 19 to act as a barrier for any liquids that might find a natural channel or fissure through the pillar walls 19. These perforated pipes in the locations 16 are more closely spaced and have a maximum amount of tape removed to ensure good drainage characteristics and thereby tend to trap any errant liquid. Subsequently, this barrier fence 16 is used to drain the hot liquid from the pillar walls 19 during subsequent removal of the bitumen values from the pillar walls 19.

Initially, the holes for the pipes 17 are drilled and the pipes 17 are put into position. The passageways 22 and 25 are sealed with barrier doors 23 to form tunnel reservoirs. The drill holes 18 are then drilled, the blast charges 20 placed therein from the passageway 12 and the oil sand body 21 is fractured in between the perforated pipes 17 and also the pillar walls 19 and the block are delineated to form the mining room. The drift 12 is sealed with barrier door 15 to form a further reservoir and the system is now ready for the flow of hot liquid.

The hot liquid can flow in several patterns, one pattern is the passage of the heated liquid from the liquid reservoir 6 into the drift 12; a cushion of air from the compressed air reservoir 7 via line 13 is also introduced into the drift 12. Surface active agents and pH agents desirable to control interfacial tension between the liquids are added at this time. The hot liquid flows into the block of oil sand deposit 21 through the blasting holes 18 under gravity and gas pressure to penetrate the cracks and fissures in the fractured block. When the upper section of the block contains low grade material it is advisable to line this upper section of the blasting holes 18 with light gage pipe to avoid washing out or the erosion of the sidewalls of the holes 18. Thus the liquid does not contact the biumen until it has reached fractured zones. The hot liquid reduces the viscosity of the cold bitumen in the block by the heat and when the liquid is solvent by the dissolving power of the solvent to form a mixture and when the hot liquid is water, to form an oil-water emulsion. These liquids are displaced laterally through the block to the drainage pipes 17 and then to the tunnel reservoirs 22 and 25 from which they can be passed to the reservoir 6 for recycling to the body or to an oil separation zone 28 to obtain production oil. The rate of flow of the hot liquids through the block is determined by gravity, gas pressure, the permeability of the block and the back pressure of the liquid filled drainage pipes 17. Some sand particles will settle in the lower tunnel reservoirs 22 and 25 and these reservoirs require flushing at regular intervals to remove the sediments.

An alternative pattern is the reverse of the above procedure where the hot liquids are fed into the tunnel reservoir 22 and 25, forced under pressure up through the pipes 17 and out into the cracks and crevices of the fractured block. The low viscosity liquids rise through the block to collect in the tunnel reservoir 12 from which the liquid can be removed for recycling or oil separation as required.

A further pattern, is to feed the hot liquid into the tunnel reservoirs 22 and 25, force the liquid up through the pipes 17 to fill the block via the cracks and crevices until the desired pressure or level of flooding of the body is reached. The pressure is then applied to the liquid in the block which added by gravity returns the enriched hot liquid through the pipes 17 to the reservoirs 22 and 25 for transfer to the reservoir 6 or as production oil. The reservoirs 22 and 25 always remain full and are equipped with heat exchangers (not shown) to add heat to the liquid particularly on recycling. Further, regular flushing is required to remove settled sediment in the reservoirs 22 and 25.

A still further flow pattern, is to pass the hot liquid from the reservoir 22 through the pipes 17 into the block and force the enriched hot liquid to move laterally across the block and drain out through the drainage pipes 17 to the reservoir 25. The enriched hot liquid is now reheated and recycled into the reservoir 22 until it achieves a satisfactory content of bitumen. This pattern has a major advantage that the level of flooding in the block may be controlled, operation is continuous and the lower portions of the block which contain the bitumen richer sand are continuously rewashed. This flow pattern is of course reversible. These patterns can be used as desired during the various phases of development of the oil sands body 21.

When the recovery of bitumen from the block falls below an economic level the room is given a final wash cycle with substantially clean hot liquid and both the room and the tunnel systems are completely drained of liquids which are now transferred to the reservoir 6. Any remaining solvent within the room and tunnel reservoir is stripped off using steam or hot air or hot flue gas. When the mining has been completed the mined out block of oil sands 21 consists of porous sand containing 25 to 30% porosity.

The enriched liquids obtained may be further heated and/or have solvent additions to form the combined oil-water mineral emulsions.

The final water and separation step takes place in a quiescent zone preferably on a batch basis using a multiplicity of pressure chambers. The combined oil by virtue of its lower specific gravity will rise to the top of the chamber while the mineral fines and heavier water occupy a lower portion of the chamber. Settling periods of up to 24 hours or more can be achieved. Compound oil is decanted off and sent to the refinery as a hot liquid where the solvent is recovered by distillation and returned to the process. The hot water is steam flashed by dropping the pressure to recover residual traces of solvent and the water then pumped as a hot liquid to the hot storage reservoir.

Figure 5:
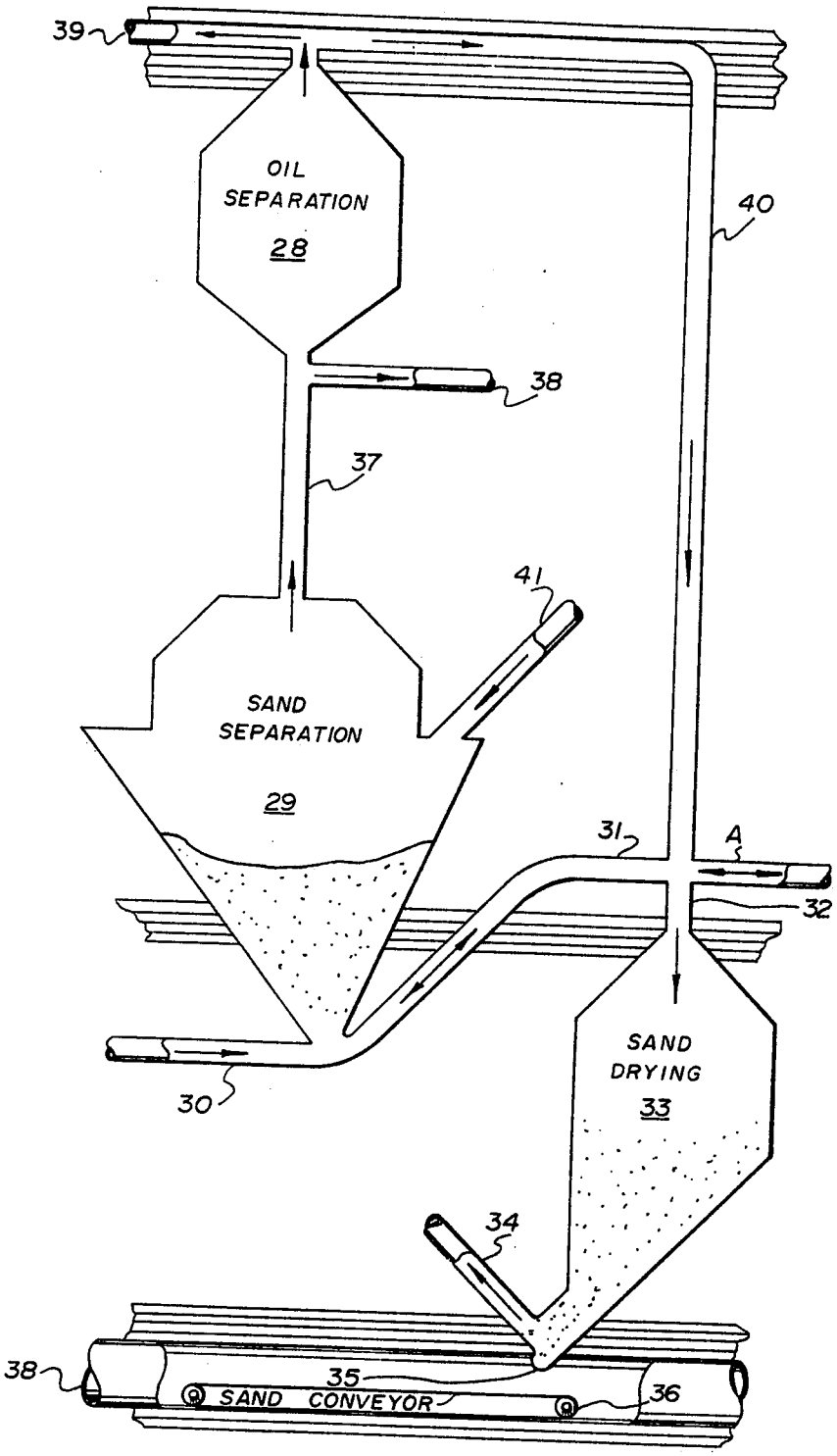
FIG. 5 is a schematic representation of the oil separation technique according to a particular embodiment of the present invention when hot water is used as the extraction liquid.

A typical separation for the combined oil is shown in FIG. 5 when hot water is used as the hot liquid.

Thus the hot bitumen water emulsion at 300° to 500° F drains under gravity and gas pressure through pipes 17 into reservoir 22. From reservoir 22 the hot oil-water emulsion is fed via line 41 to the oil-sand separation chamber 29 and is mixed enroute with a 1:1 diluent bitumen volume ratio of hot recycled diluents at 2 temperatures of 300° to 500° F. The diluent and bitumen combine to form a hot combined oil solution with a specific gravity of less than 1. All or substantially all of the finely divided bitumen particles combine with the diluent to form an oil phase leaving substantially all the mineral residue which remains water wet in suspension in the water phase. While some finely divided mineral particles of silt and clay may report to both the oil and water phase, substantially all sand particles having a size greater than 100 microns remain water wet and these particles may therefore be separated in chamber 29 and discarded. The addition of wetting agents makes it possible to obtain mineral particles properly wetted with water and to reduce the absorption of oil by the clay particles present.

In the sand separation chamber 29 a flow velocity rate is maintained to keep in suspension substantially all the particles of sizes less than 100 microns and to settle out of the water phase substantially all sand particles that are greater than 100 microns in size. Standard conventional back washing of the settled sand bed may be carried out if desired.

The coarse settled sand in chamber 29 is removed by adding high pressure water through conduits 30 to sluice a mixture of sand and water up through conduits 31 and 32 into a sand drying chamber 33. By reducing the pressure in the sand drying chamber 33, steam is released which forces the hot water out of the sand through conduit 34. By air sweeping the sand bed the balance of the moisture can be removed by evaporation. The dry sand can then be discharged from valve 35 onto conveyor 36 for disposition to the surface. If desired the coarse sand can be pumped to the surface as a slurry and the drying step carried out on conventional filters or in pressurized sand drying chambers. The sand drying step in chamber 33 is a batch process.

The combined oil and water phase together with any mineral slimes are transferred via line 37 into an oil water separation chamber 28. The separation of the oil phase from the water phase is accomplished by the addition of de-emulsifying agents followed by prolonged settling at elevated temperatures and pressure. Interfacial surface tension between the oil phase and water phase are diminished by high temperatures and the addition of the de-emulsifying agent and therefore given sufficient and ideal quiescent conditions, the majority of the mineral particles precipitate out of both oil and water phases and settle in the bottom of chamber 28 as a sludge. In the meantime, the combined oil phase rises to the top of chamber 28 and the water phase occupies the lower portion of chamber 28. To achieve maximum quiescence and to permit prolonged settling periods of up to 24 hours or more, the separation stage is a batch process. A multiplicity of pressure vessels in the limestone strata is therefore provided. The sand settled in the chamber 28 is removed via line 38 and the hot clean oil is forced out of the separation chamber by means of a fluid under pressure and passes through line 39 to the surface as feed to a refinery where the solvent is removed by distillation and recycled to the process. The settled slimes removed through line 38 may be further treated to recover any residual bitumen or solvent before being pumped to the depleted sands bed for disposal.

The settled water passing out of the oil separation chamber 28 after the oil is passed through line 40 and line 34 to the hot water storage reservoir 6 as a hot fluid under pressure. Any residual solvent in the water can be recovered by steam flashing followed by condensing.

The movement of liquids and slurries throughout the whole process system is accomplished by controlled displacement under forces of gravity and pressure without the use of mechanical pumps and great care is taken to avoid any major pressure drops in the system which will release steam and thereby cause a separation of the careful establishment of oil and water phases.

On completion of the removal of the bitumen from the mining rooms in sequence the oil sands body will have a series of spaced pillar walls 19 which can be subsequently treated in a similar manner for the removal of bitumen through the tubes 16.

The process of the present invention in its various embodiments is capable of achieving the following effects:

(a) to provide for the economic recovery of hydrocarbons from oil sands deposits,
(b) to extract bitumen values from oil sands deposits at any depth of burial without disturbing the overburden,
(c) to eliminate the mechanical problem caused by severe climatic conditions,
(d) to maintain the natural water-wet condition of the oil sands until the bitumen values have been extracted,
(e) to eliminate contact with unsaturated air and thereby avoid any evaporation of the water film on the sand grains,
(f) to maintain conditions of high pressure and high temperature during the entire extraction and separation process,
(g) to eliminate all mechanical handling until the bitumen values have been extracted,
(h) to utilize only gravity and gas pressures to remove fluids slurries or gases,
(i) to eliminate the formation of froth,
(j) to utilize existing rock strata for conduits, passageways and pressure vessel containers,
(k) to selectively mine the irregularly bedded oil sands,
(l) to create selective fractures within the oil sands deposits,
(m) to selectively water flood fractured zones,
(n) to thermally rupture the bitumen envelopes surrounding the sand grains,
(o) to provide for the separation of oil-mineral water fractions underground,
(p) to deliver separated oil to the surface as a hot liquid,
(q) to deliver a separated water to an underground storage reservoir as hot liquid,
(r) to provide for the underground disposal of all silty and clayey waste products,
(s) to provide for the clarification and reuse of process water,
(t) to provide an underground pressurized water storage reservoir which will function as a steam and water mixing chamber as an oil and mineral scavenger and as a storage vessel for hot water,
(u) to provide for the recovery of heat values from the depleted sand beds,
(v) to provide for the thermal drying underground of coarse sand particles,
(w) to deliver sand to the surface in a dried condition,
(x) to selectively remove only the bitumen,
(y) to selectively remove oily portions of the bitumen only, and
(z) to recover light hydrocarbon ends present in the formation.

The embodiments of the invention in which an exclusive property or privilege is claimed are defined as follows:

1. A method of in situ extraction of bitumen from an oil sands body which comprises sinking an access shaft through the oil sands body, driving a plurality of access drifts in the rock strata adjacent said oil sands body at least one access drift being in the rock strata underlying the oil sands body, providing at each of a plurality of locations spaced longitudinally along each access drift a plurality of bores extending in a fan-shaped pattern transversely of said access drift into said oil sands body to provide transverse rows of bores spaced longitudinally along said body in the direction of the access drifts, alternate transverse rows of bores defining rows of inlets and outlets for passage of fluid through said body, said outlets being in access drifts underlying said body, providing perforated pipes in those portions of the bores defining the outlets in said body, the perforations in the pipes being dimensioned to prevent said particles from said body passing therethrough, increasing the permeability of the body by causing fracturing of the body through the inlet bores to provide a fractured block of oil sands in said body defining an enclosed mining room capable of retaining liquids and gases under pressure surrounded by undisturbed solid pillar walls on all four sides of said room, sealing the ends of the access drifts to provide a closed reservoir system capable of delivering and removing fluid through said inlets and outlets and associated access drifts, flooding the block at all elevations at substantially the same time via said inlets at a temperature and for a residence time sufficient to raise the temperature of the block by an amount to cause the bitumen to become flowable with said fluid and removing the fluid-bitumen mixture so formed from all desired levels in said block substantially at the same time through said outlets and associated access drift and separating said bitumen from said fluid.

2. A method as claimed in claim 1 in which the bitumen content of various layers of the block through which each bore forming the outlets extends is determined and perforated pipes are inserted into said bores, the size, number and disposition of the perforations in the pipe being such as to selectively remove bitumen from the bitumen rich layers of the blocks.

3. A method as claimed in claim 1 in which each bore has a length determined by the bitumen content of the upper layers of the block so as to selectively remove bitumen only from bitumen rich portions of the upper layers of the block.

4. A method as claimed in claim 1 in which the block is fractured by removing, by means of high pressure hot water jets, the lower 20 to 30% by volume of the sand in the block whereby the upper portions of the block collapse to cause said fracturing.

5. A method as claimed in claim 1 in which the pillar walls of the room also contain perforated tubes for collecting fluid passing into said walls from said room, the fluid being removed from said room for recovery of bitumen therefrom.

6. A method as claimed in claim 1 in which the fluid is a hot liquid.

7. A method as claimed in claim 6 in which the room is flooded to a level only sufficient to remove bitumen from the bitumen rich layers of sand in said block.

8. A method as claimed in claim 7 in which the level to which the extent of flooding of the room is controlled by the rate of flow of liquid into the room and removal therefrom and also by a gas under pressure passed into said room.

9. A method as claimed in claim 6 in which the liquid is a water-immiscible low-viscosity organic solvent for said bitumen.

10. A method as claimed in claim 8 in which the organic solvent is introduced into said room under high pressure and at a temperature not in excess of 130° F for a residence time sufficient to raise the temperature of the sand in the block to be in the range 90° to 130° F whereby to primarily remove bitumen from said block with a minimum of removal of water.

11. A method as claimed in claim 10 in which removed bitumen solution is heated to 250° to 400° F, allowed to settle in a pressure vessel whereby any water and sand present in said solution is separated therefrom by decantation and the solvent removed from the bitumen by flash evaporation by releasing the pressure in said vessel, the solvent being condensed by recycled to a reservoir from which the room is flooded therewith.

12. A method as claimed in claim 9 in which the residual solvent in said room when all the recoverable bitumen has been removed therefrom is recovered by sweeping the room with an inert hot gas.

13. A method as claimed in claim 12 in which the hot gas is steam or hot air admixed with steam.

14. A method as claimed in claim 12 in which the hot gas is a flue gas generated by burning a combustible product in an upper tunnel and feeding the gas through blast holes used in fracturing the block or by ignition of low grade bitumen deposits in the upper portion of the block.

15. A process as claimed in claim 9 in which the solvent is fed into said room at a high temperature sufficient to break down liquid water envelopes surrounding the sand particles and flush them from the block together with their fines until 20 to 30% of the bitumen has been removed thereby providing substantial cavities within the block, the temperature of the solvent being then reduced to a temperature not in excess of 130° F.

16. A method as claimed in claim 9 in which the solvent is selected from liquified petroleum gases or light oils of boiling points from 70° to 150° C which are of saturated aliphatic composition.

17. A method as claimed in claim 6 in which the liquid is water which is fed into said room at a high temperature and at a high pressure to form an emulsion of water and bitumen which is removed from the room.

18. A method as claimed in claim 17 in which the pressure in the room is periodically reduced to cause ebullition of the water and generation of steam whereby to enhance rupture of bitumen envelopes around the sand the pressure being periodically increased to condense the generated steam.

19. A method as claimed in claim 17 in which the flooding and subsequent removal and separation of the bitumen from the water is at a pressure sufficient to substantially avoid the presence of froth in the emulsion.

20. A method as claimed in claim 17 in which an inert gas pressure is maintained in the room to assist in drainage of the emulsion therefrom.

21. A method as claimed in claim 17 in which the emulsion is removed from said room at a low velocity to minimize sand entrainment in said emulsion.

22. A method as claimed in claim 17 in which the water is passed into said room through said perforated pipes at a high velocity to effect flooding of the room to thereby sweep the interstices of the sand particles located near the pipe perforations essentially clean.

23. A method as claimed in claim 17 in which the water contains at least one of an emulsifying agent and a pH controlling agent.

24. A method as claimed in claim 17 in which the water contains an organic solvent for the bitumen.

25. A method as claimed in claim 17 in which the emulsion withdrawn from the room is passed to a sand separator at high temperature and under high pressure and at a velocity sufficient to maintain sand particles of less than 100 micron size in suspension, separating sand particles of over 100 micron size in said sand separator and passing of emulsion from said sand separator into an oil-water separation chamber, adding diluent to the emulsion after leaving said room and before passage to said separation chamber in an amount sufficient to form a combined oil of density less than 1, permitting separation of the oil, water and fine sand solids by gravity settling under conditions of high temperature and high pressure, removing the fine solids as a sludge from the separation chamber and at least part of the water and removing bitumen from the separation chamber by fluid under pressure, as a hot fluid for passage to the surface for refining thereof.

26. A method as claimed in claim 25 in which the diluent is added to the emulsion as it leaves the mining room and is mixed during passage of the emulsion to the sand separator.

27. A method as claimed in claim 26 in which the diluent is added to the emulsion as it passes from the sand separator to the separation chamber.

28. A method as claimed in claim 25 in which a back pressure is maintained in the separation chamber to provide for non-turbulent removal of bitumen from the separation chamber and the subsequent filling up of the separation chamber with further emulsion for separation.

29. A method as claimed in claim 25 in which the sand is removed from the sand separator and passed to a drying vessel where it is flash dried by reducing the pressure in the drying vessel.

30. A method as claimed in claim 25 in which the water separated from the emulsion is recycled to a reservoir for further flooding of a mining room.

31. A method as claimed in claim 17 in which recycled water is clarified by slow passage through the sand in a mining room from which the bitumen has previously been exhausted.

32. A method as claimed in claim 31 in which the recycled water or fresh water for flooding the mining room is heated by passage through the sand of a body of a mining room from which the bitumen has been exhausted.

33. A method as claimed in claim 1 in which conduits, pressure vessels and storage vessels are all formed out of the rock strata.

34. A method as claimed in claim 1 in which pressures and flows of the fluids are provided by gravity and gas pressure.

35. A method as claimed in claim 1 in which the block is selectively fractures to fracture essentially only those portions which are oil rich by selective placement of blasting charges in balsting bore forming the inlets, those portions of said blasting bores passing through low oil bearing portions of the block having a light gauge liner disposed therein which liner also subsequently serves for passage of hot fluid through the block.

36. A method as claimed in claim 1 in which the hot fluid is a hot gas.

37. A method as claimed in claim 36 in which the hot gas is steam air, carbon dioxide or a flue gas heated externally of the mining room.

38. A process as claimed in claim 1 in which the extraction of the bitumen with the fluid and separation of said bitumen from the fluid takes place in a closed pressurized circuit.

39. A method as claimed in claim 1 which comprises driving access drifts into the rock strata above and below the oil sands body providing at least two fan shaped sets of generally upwardly extending bores emanating from the lower access drifts into the oil sands body in a pattern of contiguous parallel planes transverse to the drifts, providing said perforated pipes in those portions of the bores within the oil sands body, providing at least two fan shaped sets of generally downwardly inclined bores emanating from the overhead drifts into the oil sands body in a pattern of contiguous parallel planes transverse to the drifts and located in a position midway between the initial planes of upwardly inclined bores containing the perforated pipes thereby producing an overlapping continuous pattern of alternate planes of bores, exploding explosive charges selectively placed in the bores emanating from the upper drifts to produce a series of intercommunicating fractures between the alternate planes of bores, providing sufficient sets of these alternate planes of bores to delineate the fractured block of oil sands containing a plurality of the perforated pipes which is surrounded by the undisturbed pillar walls on all four sides, thus forming an enclosed mining room substantially capable of retaining liquids and gases under pressure, sealing the branch tunnels with bulkheads to provide a closed reservoir system capable of delivering or removing fluids through a plurality of bores without the necessity of mechanical seals, valves or piping, flooding the oil sand block or room from the upper tunnel by forcing hot fluids down through the planes of fractured bores and into the intercommunicating fractures at essentially all elevations at essentially the same time and at a temperature and for a residence time sufficient to raise the temperature of the oil sand by an amount to cause the bitumen to become flowable with the said fluid and removing the said fluid bitumen so formed, the passage of the said fluid through the said bed being via the said perforated pipes into the lower access drifts and separating the said bitumen from the said fluid.

40. A method as claimed in claim 1 which comprises driving access drifts in the underlying rock strata, providing at least two fan shaped sets of generally upwardly extending bores emanating from the first access drifts into the oil sands body in a pattern of contiguous parallel planes transverse to the drifts, providing the perforated pipes in those portions of the bores within the oil sand body, providing at least two fan shaped sets of generally upwardly extending bores emanating from the second access drifts into the oil sand body in a pattern of contiguous parallel planes transverse to the drifts and located in positions midway between the initial planes of bores containing the perforated pipes therby producing an overlapping continuous pattern of alternate planes of bores, exploding explosive charges selectively placed in the bores emanating from the second drifts to produce a series of intercommunicating fractures between the alternate planes of bores, providing sufficient sets of these alternate planes of bores to delineate a fractured block of oil sands containing a plurality of perforated pipes which is surrounded by undisturbed pillar walls on all four sides thus forming an enclosed mining room substantially capable of retaining liquids and gases under pressure, sealing the branch tunnels with bulkheads to provide a closed reservoir system capable of delivering or removing fluids through a plurality of bore holes without the necessity of mechanical seals, valves or piping, suitably flooding the oil sand block from the second access drifts by forcing hot fluids up through the planes of fractured bores and into the intercommunicating fractures at essentially all elevations at essentially the same time and at a temperature and for a residence time sufficient to raise the temperature of the oil sands by an amount to cause the bitumen to become flowable with the said fluid and removing the said fluid-bitumen so formed, the passage of the said fluid through the said bed being via the said perforated pipes into the first access drifts and separating the said bitumen from said fluid.

* * * * *